US009322603B2

(12) United States Patent
Hyodo et al.

(10) Patent No.: US 9,322,603 B2
(45) Date of Patent: Apr. 26, 2016

(54) WORK MACHINE

(75) Inventors: Koji Hyodo, Kasumigaura (JP); Kazuo Chounan, Moriya (JP); Tetsuji Tanaka, Abiko (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 671 days.

(21) Appl. No.: 13/704,937

(22) PCT Filed: Jun. 9, 2011

(86) PCT No.: PCT/JP2011/063277

§ 371 (c)(1),
(2), (4) Date: Dec. 17, 2012

(87) PCT Pub. No.: WO2011/158733

PCT Pub. Date: Dec. 22, 2011

(65) Prior Publication Data

US 2013/0092366 A1 Apr. 18, 2013

(30) Foreign Application Priority Data

Jun. 18, 2010 (JP) ..... 2010-139087

(51) Int. Cl.
*F01P 7/02* (2006.01)
*F28F 27/02* (2006.01)
(Continued)

(52) U.S. Cl.
CPC ..... *F28F 27/02* (2013.01); *E02F 9/226* (2013.01); *E02F 9/2292* (2013.01);
(Continued)

(58) Field of Classification Search
CPC ..... F01P 7/02; F01P 2025/62; F28F 27/02
USPC ..... 165/271, 300, 121, 299; 123/41.12, 123/41.08
See application file for complete search history.

(56) References Cited

U.S. PATENT DOCUMENTS 8,632,314 B2 * 1/2014 Imaizumi et al. ..... 417/22
8,646,417 B2 * 2/2014 Watanabe et al. ..... 123/41.1
(Continued)

FOREIGN PATENT DOCUMENTS

CN 1169176 A 12/1997
CN 1807917 A 7/2006
(Continued)

OTHER PUBLICATIONS

International Search Report dated Sep. 20, 2011 (two (2) pages).
(Continued)

*Primary Examiner* — Marc Norman
*Assistant Examiner* — Devon Russell
(74) *Attorney, Agent, or Firm* — Crowell & Moring LLP

(57) ABSTRACT

A work machine includes a thermostat provided upon a path that conducts the cooling water to the radiator, and that opens and closes the path according to a temperature of the cooling water, a fan device that blows external air at the radiator, an output changeover switch that changes over output of the engine between high and low, a rotational speed setting unit that sets a rotational speed for the fan device according to the temperature of the cooling water, and a rotational speed adjustment unit that adjusts rotational speed of the fan device, wherein, within a temperature range for the cooling water in which the thermostat is fully opened from fully closed, the rotational speed of the fan device to be lower when the output changeover switch is changed over so as to limit the output of the engine.

9 Claims, 13 Drawing Sheets

(51) Int. Cl.
*E02F 9/22* (2006.01)
*F01P 7/04* (2006.01)

(52) U.S. Cl.
CPC ..... *E02F 9/2296* (2013.01); *F01P 7/04* (2013.01); *F01P 7/044* (2013.01); *F01P 2025/30* (2013.01); *F01P 2025/64* (2013.01); *F02D 2250/26* (2013.01)

(56) References Cited

U.S. PATENT DOCUMENTS

| | | | | |
|---|---|---|---|---|
| 8,794,194 | B2 * | 8/2014 | Takiguchi | 123/41.08 |
| 2006/0096554 | A1 * | 5/2006 | Shiozaki | 123/41.12 |
| 2007/0016355 | A1 * | 1/2007 | Kamado et al. | 701/103 |
| 2008/0006027 | A1 * | 1/2008 | Ozawa et al. | 60/429 |
| 2008/0202468 | A1 * | 8/2008 | Grill et al. | 123/339.14 |
| 2009/0240406 | A1 * | 9/2009 | Fukushima et al. | 701/54 |
| 2009/0241865 | A1 * | 10/2009 | Stramecki | 123/41.12 |
| 2010/0064991 | A1 * | 3/2010 | Mizoguchi et al. | 123/41.12 |
| 2014/0137816 | A1 * | 5/2014 | Jung et al. | 123/41.08 |

FOREIGN PATENT DOCUMENTS

| | | | |
|---|---|---|---|
| CN | 101541601 | A | 9/2009 |
| DE | 195 35 674 | A1 | 3/1997 |
| JP | 9-49427 | A | 2/1997 |
| JP | 11-294164 | A | 10/1999 |
| JP | 2000-303837 | A | 10/2000 |
| JP | 2001-182535 | A | 7/2001 |
| JP | 2005-069203 | A | 3/2005 |
| JP | 2005-273473 | A | 10/2005 |
| JP | 2007-170236 | A | 7/2007 |
| JP | 2009-144539 | A | 7/2009 |
| WO | WO 2009/017638 | A1 | 2/2009 |

OTHER PUBLICATIONS

Chinese Office Action dated Oct. 24, 2014 (seven (7) pages).

Extended European Search Report dated Feb. 5, 2014 (nine (9) pages).

* cited by examiner

WORK MACHINE

TECHNICAL FIELD

The present invention relates to a work machine that is capable of changing over the output of its engine between high and low.

BACKGROUND ART

In order to cool the cooling water of the engine of a work machine, the work machine is provided with a radiator and with a cooling fan that blows air at the radiator. One such type of cooling fan is driven by a hydraulic motor or the like that is driven independently from the engine. And a type of hydraulically driven cooling fan is known that is capable of performing cooling efficiently due to the rotational speed of the cooling fan being changed according to the temperature of the cooling water and according to the engine rotational speed (refer to Patent Document #1).

CITATION LIST

Patnet Literature

Patent Document #1: Japanese Laid-Open Patent Publication 2001-182535.

SUMMARY OF THE INVENTION

Technical Problem

However, with the hydraulically driven cooling fan described in the above Patent Document, the rotational speed of the cooling fan is simply changed only according to the temperature of the cooling water of the engine and according to the engine rotational speed, and this control of the rotational speed of the cooling fan is not performed with any relationship to the output of the engine.

Means for Solution

According to the 1st aspect of the present invention, a work machine, comprises: an engine; a radiator for cooling a cooling water of the engine; a thermostat, provided upon a path that conducts the cooling water to the radiator, and that opens and closes the path between fully closed and fully open according to a temperature of the cooling water; a fan device that blows external air at the radiator; an output changeover switch that changes over output of the engine between high and low; a rotational speed setting unit that sets a rotational speed for the fan device according to the temperature of the cooling water; and a rotational speed adjustment unit that adjusts rotational speed of the fan device so that it becomes equal to the rotational speed set by the rotational speed setting unit, wherein: within a temperature range for the cooling water in which the thermostat is fully opened from fully closed, the rotational speed setting unit sets the rotational speed of the fan device to be lower when the output changeover switch is changed over so that the output of the engine becomes low, as compared to when the output changeover switch is changed over so that the output of the engine becomes high.

According to the 2nd aspect of the present invention, in a work machine according to the 1st aspect, it is preferred that, also at temperatures between a predetermined temperature lower than a temperature at which the thermostat starts to open and a predetermined temperature higher than a temperature at which the thermostat is fully open, the rotational speed setting unit sets the rotational speed of the fan device to be low when the output changeover switch is changed over so that the output of the engine becomes low, as compared with when the output changeover switch is changed over so that the output of the engine becomes high.

According to the 3rd aspect of the present invention, a work machine according to the 1st or 2nd aspect, further comprises: a hydraulic oil cooler for cooling hydraulic oil supplied by a hydraulic pump; and a hydraulic oil temperature dependent rotational speed setting unit that sets the rotational speed of the fan device according to the temperature of the hydraulic oil, wherein: the fan device blows external air at the radiator and the hydraulic oil cooler; and the rotational speed setting unit adjusts the rotational speed of the fan device so that it becomes a higher rotational speed among a rotational speed set by the rotational speed setting unit, and a rotational speed set by the hydraulic oil temperature dependent rotational speed setting unit.

According to the 4th aspect of the present invention, a work machine according to the 1st or 2nd aspect, further comprises: a hydraulic fluid cooler for cooling hydraulic fluid of a torque converter that transmits propulsion drive force; and a hydraulic fluid temperature dependent rotational speed setting unit that sets the rotational speed of the fan device according to a temperature of the hydraulic fluid, wherein: the fan device blows external air at the radiator and the hydraulic fluid cooler; and the rotational speed setting unit adjusts the rotational speed of the fan device so that it becomes a higher rotational speed among a rotational speed set by the rotational speed setting unit and a rotational speed set by the hydraulic fluid temperature dependent rotational speed setting unit.

According to the 5th aspect of the present invention, a work machine according to the 1st or 2nd aspect, further comprises: a hydraulic oil cooler for cooling hydraulic oil supplied by a hydraulic pump; a hydraulic oil temperature dependent rotational speed setting unit that sets the rotational speed of the fan device according to a temperature of the hydraulic oil; a hydraulic fluid cooler for cooling hydraulic fluid of a torque converter that transmits propulsion drive force; and a hydraulic fluid temperature dependent rotational speed setting unit that sets the rotational speed of the fan device according to a temperature of the hydraulic fluid, wherein: the fan device blows external air at the radiator, the hydraulic oil cooler, and the hydraulic fluid cooler; and the rotational speed setting unit adjusts the rotational speed of the fan device so that it becomes a highest rotational speed among a rotational speed set by the rotational speed setting unit, a rotational speed set by the hydraulic oil temperature dependent rotational speed setting unit, and a rotational speed set by the hydraulic fluid temperature dependent rotational speed setting unit.

According to the 6th aspect of the present invention, in a work machine according to any one of the 1st through 5th aspects, it is preferred that, if the temperature of the cooling water is greater than or equal to a predetermined temperature higher than a temperature at which the thermostat is fully open, the rotational speed setting unit sets to a same rotational speed as when the output changeover switch is changed over so that the output of the engine becomes high, even when the output changeover switch is changed over so that the output of the engine becomes low.

Advantageous Effect of the Invention

According to the present invention, it is possible to anticipate reduction of the amount of fuel consumed and reduction of the fan noise.

DESCRIPTION OF THE EMBODIMENTS

—Embodiment One—

Figure 1:
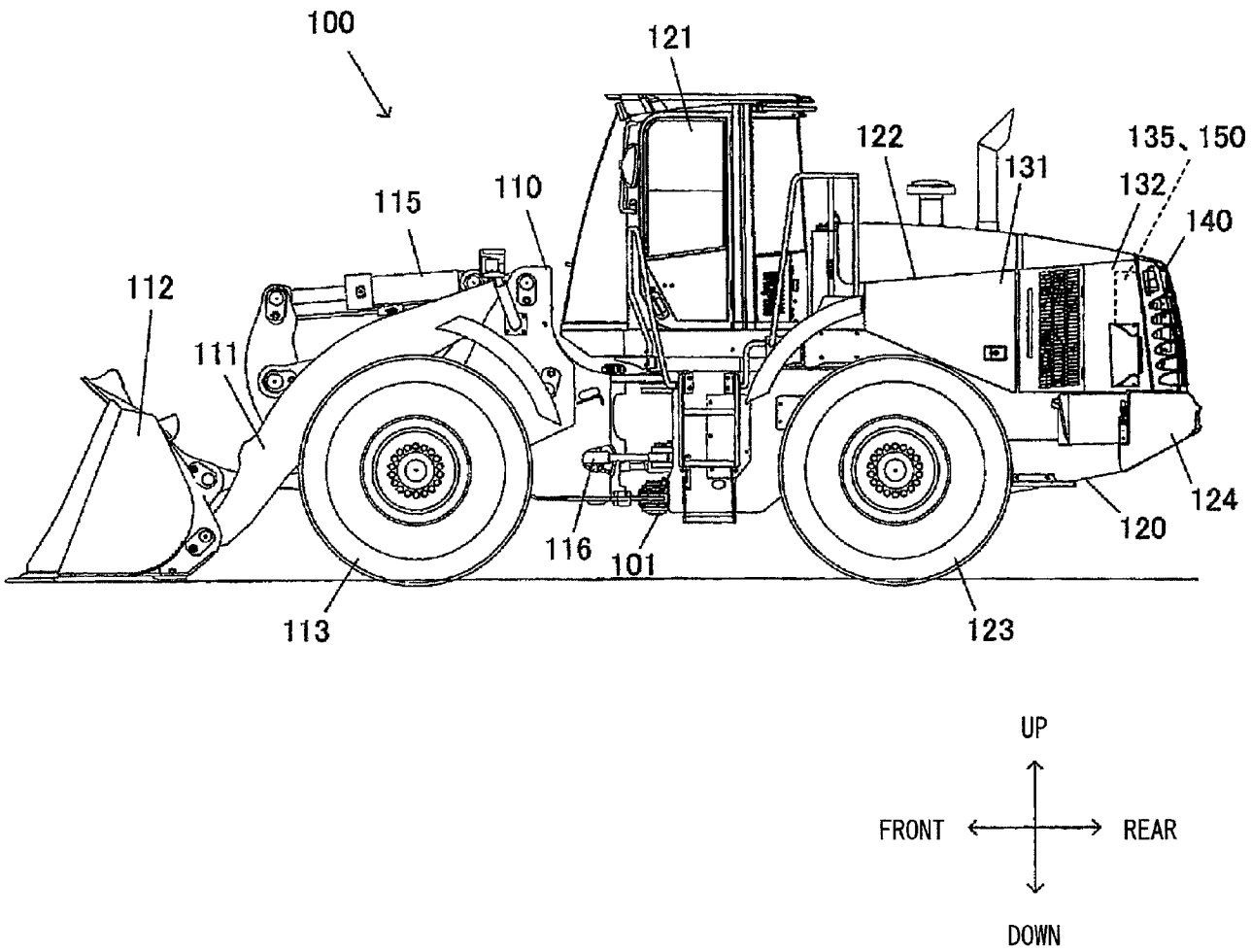
FIG. 1 is a side view of a wheel loader 100 according to a first embodiment.

A first embodiment of the work machine of the present invention will now be explained with reference to FIGS. 1 through 8. FIG. 1 is a side view of a wheel loader that is an example of a work machine according to this embodiment. This wheel loader 100 includes a front vehicle body portion 110 that includes arms 111, a bucket 112, tires 113, and so on, and a rear vehicle body portion 120 that includes a driver compartment 121, an engine compartment 122, tires 123, and so on. The engine compartment 122 is covered over by an engine enclosure 131. And a counterweight 124 is attached at the rear of the rear vehicle body portion 120.

The arms 111 are turned in the vertical direction (i.e., are moved to elevate) by the operation of arm cylinders not shown in the figures, and the bucket 112 is turned in the vertical direction (i.e. to perform dumping or crowding) by the operation of a bucket cylinder 115. The front vehicle body portion 110 and the rear vehicle body portion 120 are connected together by a center pin 101 so that they can mutually rotate freely, and the front vehicle body portion 110 is flexed to the left and right with respect to the rear vehicle body portion by the extension and retraction of steering cylinders 116.

Figure 2:
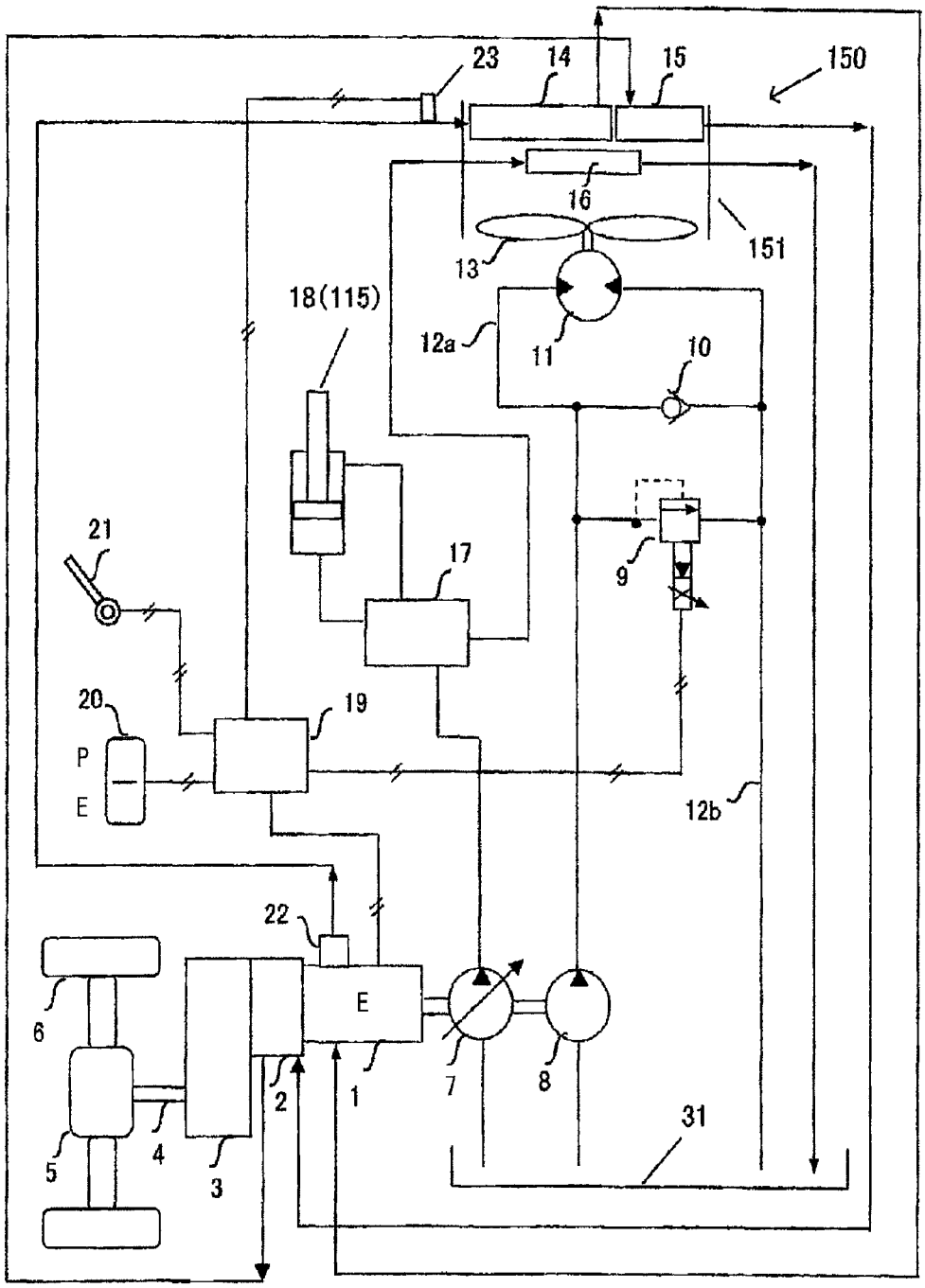
FIG. 2 is a figure showing the general structure of the wheel loader 100.

A radiator frame 135 and an air cooling fan unit 150 are disposed behind the engine enclosure 131. To the radiator frame 135 there are attached a radiator 14 that cools the cooling water of an engine 1, an oil cooler 16 that cools hydraulic oil, and a hydraulic fluid cooler 15 for cooling the hydraulic oil of the torque converter 2, as shown in FIG. 2 and described hereinafter. The radiator frame 135 is fixed to the rear vehicle body portion 120. The air cooling fan unit 150 is provided with an air cooling fan that is driven by a fan motor 11 and a fan shroud 151, as shown in FIG. 2 and described hereinafter, and is provided at the rear of the radiator frame 135.

The side- and upper surfaces of the radiator frame 135 and the air cooling fan unit 150 are covered over by a cooling unit enclosure 132 (see FIG. 1). This cooling unit enclosure opens at the rear, and is covered by a grille 140 that is attached so as to be opened and closed. The grille 140 is a cover that is provided with a plurality of apertures, so that intake of air to the air cooling fan 13 can flow from the exterior, or exhausted air can flow outward.

FIG. 2 is a figure showing the general structure of this wheel loader 100. An input shaft, not shown in the figure, of a torque converter 2 is connected to the output shaft of the engine 1, and an output shaft, not shown in the figure, of the torque converter 2 is connected to a transmission 3. The torque converter 2 is a per se known fluid clutch including an impeller, a turbine, and a stator, and the rotation of the engine 1 is transmitted to the transmission 3 via the torque converter 2. The transmission 3 includes fluid pressure clutches that change over the speed stage to any one of a first speed through a fourth speed, and thus the rotation of the output shaft of the torque converter 2 is speed changed by the transmission 3. After having been speed changed, the rotation is transmitted to the tires 6 via a propeller shaft 4 and an axle 5, and thereby this wheel loader is propelled.

The wheel loader 100 includes a hydraulic pump for working 7 that is driven by the engine 1, a control valve 17 that controls the pressurized oil discharged from the hydraulic pump for working 7, and a hydraulic cylinder for working 118 (for example, the bucket cylinder 115 and the arm cylinders). The wheel loader 100 also includes an hydraulic pump 8 for driving the fan motor 11, a variable relief valve 9 for controlling the rotational speed of the fan motor 11, the fan motor 11 and the air cooling fan 13 described above, and a check valve 10 for preventing cavitation when, due to change of the rotational speed of the engine 1, a hydraulic circuit 12a that drives the fan motor 11 goes to negative pressure.

The cooling water of the engine 1 flows to a radiator 14 via a thermostat 22, and returns back to the engine 1 after having been cooled by the radiator 14. The thermostat 22 is provided partway along a cooling water conduit that leads from the engine 1 to the radiator 14, and adjusts its opening amount from fully closed to fully open, according to the temperature of the cooling water. It will be supposed that, with the thermostat 22 of this embodiment, the temperature at which it starts to open is 85° C., while it becomes fully open at 95° C. In other words: the thermostat 22 is fully closed until the temperature of the cooling water that is in contact with the thermostat 22 is 85° C.; when the temperature exceeds 85° C., the thermostat 22 starts to open gradually and its aperture area increases; and, when the temperature reaches 95° C., the thermostat 22 reaches fully open.

The hydraulic oil is sucked up from a hydraulic oil tank 31 by the hydraulic pump for working 7 and is then discharged therefrom and flows into an oil cooler 16 via the control valve 17, and returns back to the hydraulic oil tank 31 after having been cooled by the oil cooler 16. And the hydraulic fluid of the torque converter 2 flows from the torque converter 2 to a hydraulic fluid cooler 15, and returns back to the torque converter 2 after having been cooled by the hydraulic fluid cooler 15.

Moreover, in order to control the rotation of the fan motor 11, as described hereinafter, this wheel loader 100 includes a controller 19, an engine output mode changeover switch 20, an accelerator pedal actuation amount detection sensor 21, and a cooling water temperature sensor 23. The controller 19 is a control device that controls the various sections of the wheel loader 100. The engine output mode changeover switch 20 is a changeover switch with which the operator selects either a P mode in which the output of the engine 1 is not limited, or an E mode in which during light load the output of the engine is limited, whereby reduction of the fuel consumption amount is envisaged. In other words, when the engine output mode changeover switch 20 is changed over to the P mode, the controller 19 does not particularly limit the output of the engine 1; while, when the engine output mode changeover switch 20 is changed over to the E mode, the controller 19 limits the output of the engine 1 as will be described hereinafter.

The accelerator pedal actuation amount detection sensor 21 is a sensor that detects the amount by which an accelerator pedal not shown in the figures is actuated. And the cooling water temperature sensor 23 is a sensor that detects the temperature of the cooling water before it is cooled, and is provided in a conduit or the like on the upstream side of the radiator 14.

Figure 3:
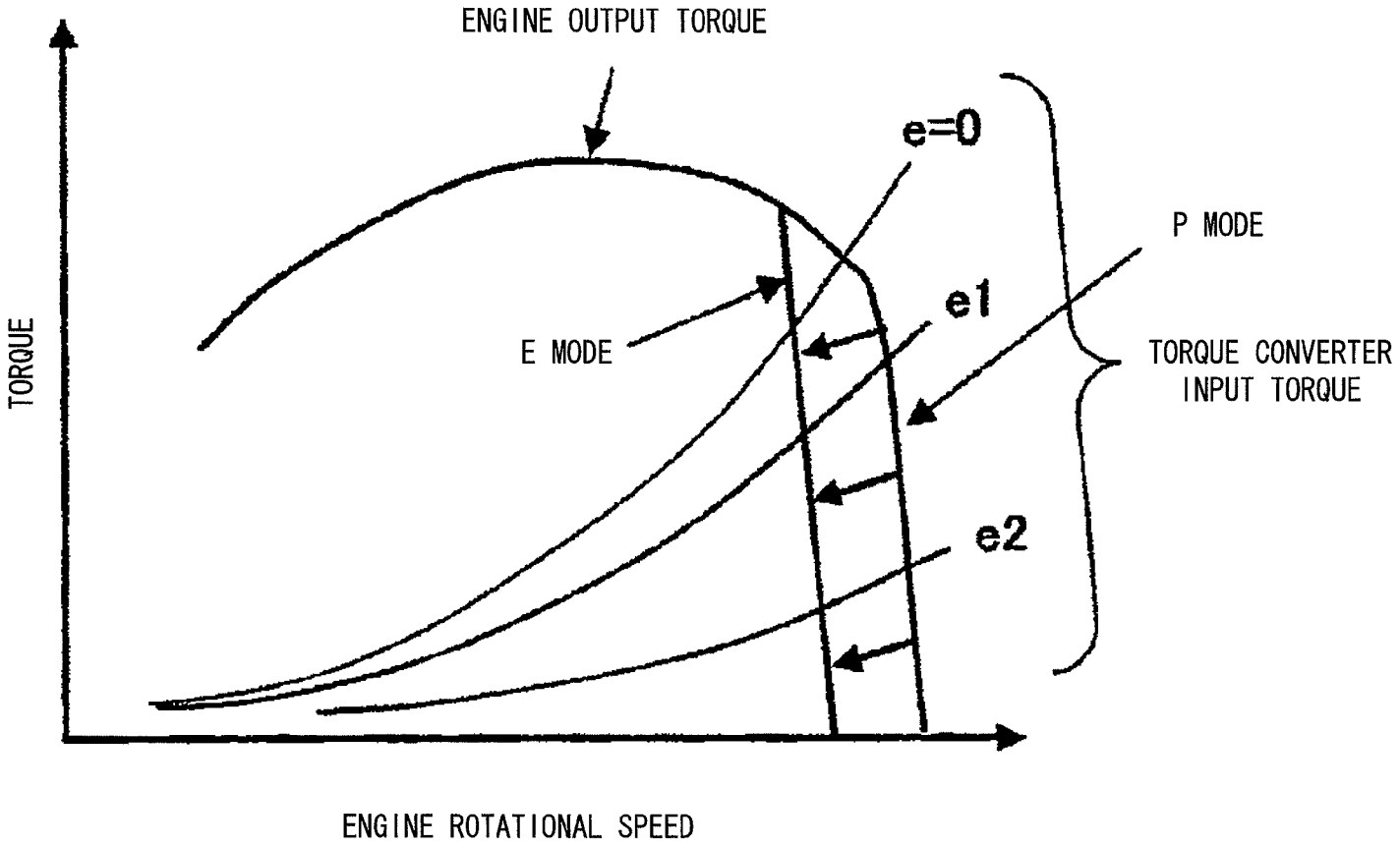
FIG. 3 is a figure showing a torque curve of an engine 1 and curves of input torque to a torque converter 2.
Figure 4:
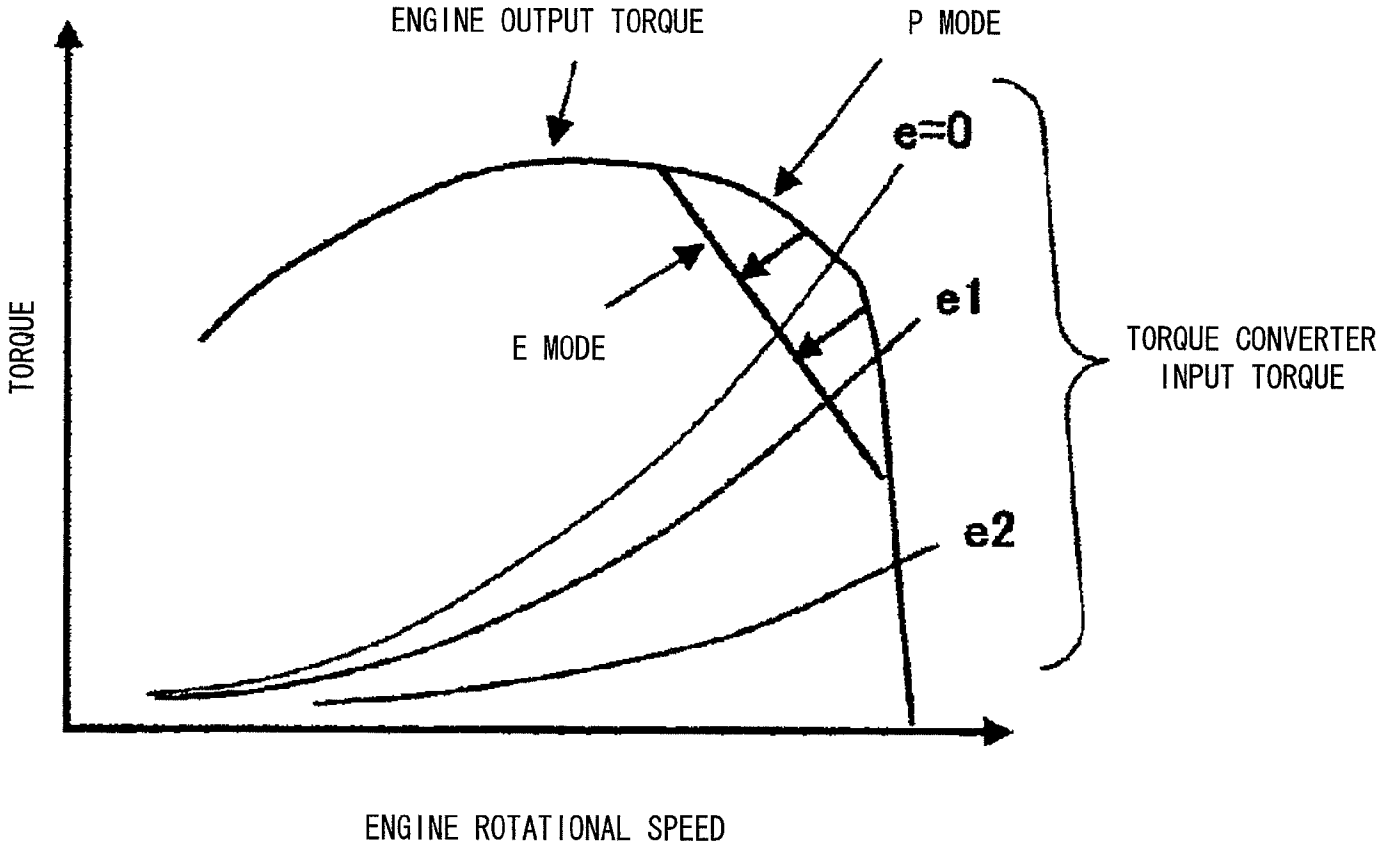
FIG. 4 is another figure showing a torque curve of the engine 1 and curves of input torque to the torque converter 2.

With the wheel loader 100 having the structure described above, for limitation of the output of the engine 1, there are a method of limiting the highest rotational speed of the engine, as shown for example in FIG. 3, and a method of limiting the engine output torque, as shown in FIG. 4. FIGS. 3 and 4 are figures showing curves for the torque of the engine 1, and curves for the torque inputted to the torque converter 2.

In FIGS. 3 and 4, e is the torque converter speed ratio e (=Nt/Ni), i.e. the ratio of the rotational speed of the output shaft Nt of the torque converter 2 to the rotational speed Ni of its input shaft. The point of intersection of the torque curve of the engine 1 and the input torque curve of the torque converter 2 is the input torque that is actually inputted to the torque converter 2 in order to propel the wheel loader 100. And the input torque to the torque converter 2 increases in proportion to the square of the rotational speed Ni of the input shaft 21 of the torque converter 2 (in other words, the rotational speed of the engine 1). Accordingly, when the maximum rotational speed of the engine or the output torque is limited (i.e. when E mode is set), then the input torque to the torque converter 2 is reduced as compared to when it is not limited (i.e. when P mode is set). In other words, the point of intersection of the torque curve of the engine 1 and the input torque curve of the torque converter 2 in FIGS. 3 and 4 shifts towards the lower left of the figure.

The power inputted to the torque converter 2 (in other words the output of the engine 1) is given by the product of the input torque to the torque converter 2 and the rotational speed Ni of its input shaft (in other words the rotational speed of the engine 1). And the power loss in the torque converter 2 is given by the following Equation (1):

$$\text{Power loss}=(\text{power inputted to torque converter 2})\times(1-\eta) \quad (1)$$

Here, $\eta$ is the power transmission efficiency of the torque converter 2.

Accordingly, when the maximum rotational speed of the engine or the output torque is limited, the power inputted to the torque converter is reduced and the power loss in the torque converter 2 is diminished, as compared to when neither thereof is limited. When the E mode is set in this manner, the output of the engine becomes lower as compared to when the P mode is set.

Figure 5:
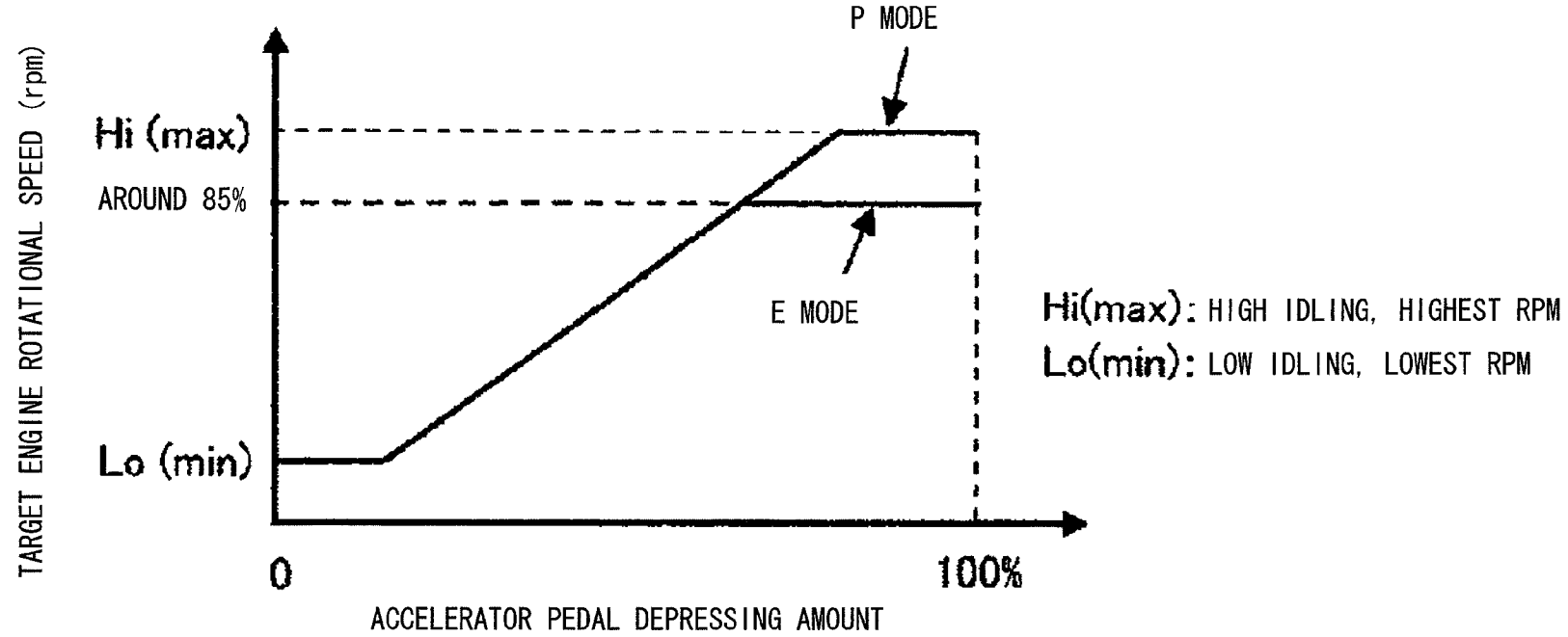
FIG. 5 is a figure showing a relationship of target engine rotational speed with respect to the amount of depression of an accelerator pedal.
Figure 6:
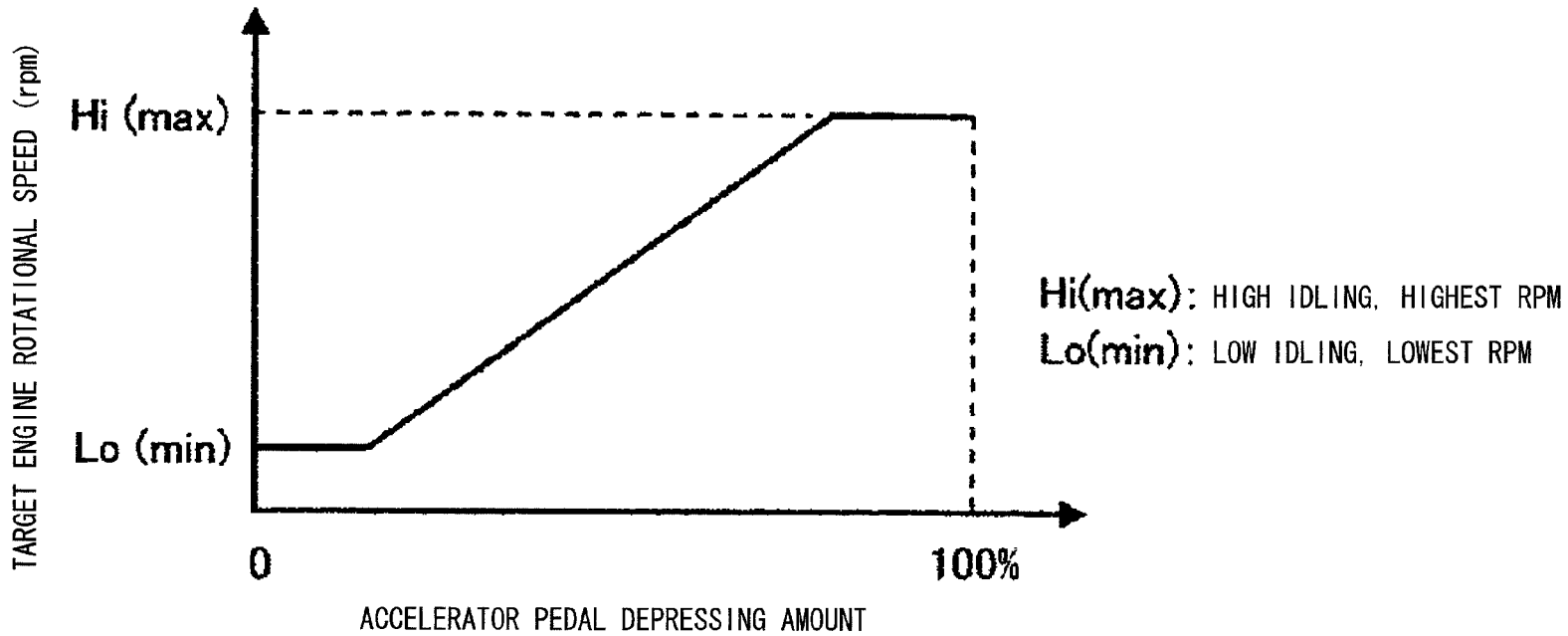
FIG. 6 is another figure showing a relationship of target engine rotational speed with respect to the amount of depression of the accelerator pedal.

FIGS. 5 and 6 are figures showing the relationship between target engine rotational speed with respect to the amount of depression of the accelerator pedal. When the P mode is set, the maximum rotational speed of the engine is not limited, and the target engine rotational speed changes from a low idling speed (Lo(min)) that is the lowest rotational speed to a high idling speed (Hi(max)) that is the highest rotational speed, according to the amount of depression of the accelerator pedal (see FIG. 5). And, when the E mode is set, if control is performed so that the maximum engine rotational speed is limited, then, while the target engine rotational speed increases from Lo(min) along with increase of the amount of depression of the accelerator pedal, its upper limit value only becomes 85% of Hi(max), for example. It should be understood that, when the E mode is set, if control is performed so that the engine output torque is limited, then, in a similar manner to when the P mode is set, along with increase of the amount of depression of the accelerator pedal, the target engine rotational speed changes from Lo(min) that is the lowest rotational speed to Hi(max) that is the highest rotational speed (see FIG. 6).

Since in this manner the output of the engine 1 is lower when the E mode is set as compared to when the P mode is set, accordingly the amount of heat generated from the engine 1 is also lower. Thus, when the E mode is set, a lower amount of heat dissipation from the radiator 14 suffices, as compared to when the P mode is set. In other words, if the temperature of the cooling water is to be the same, it is possible to lower the rotational speed of the air cooling fan 13. In this embodiment, the target rotational speed for the air cooling fan 13 (in other words for the fan motor 11) is set with respect to the cooling water temperature by doing as described below, so that the rotational speed of the air cooling fan 13 is reduced when the E mode is set, as compared to when the P mode is set. And, by controlling the relief pressure of the variable relief valve 9, the controller 19 adjusts the rotational speed of the fan motor 11 to reach this target rotational speed for the fan motor 11 that is set on the basis of the cooling water temperature.

Figure 7:
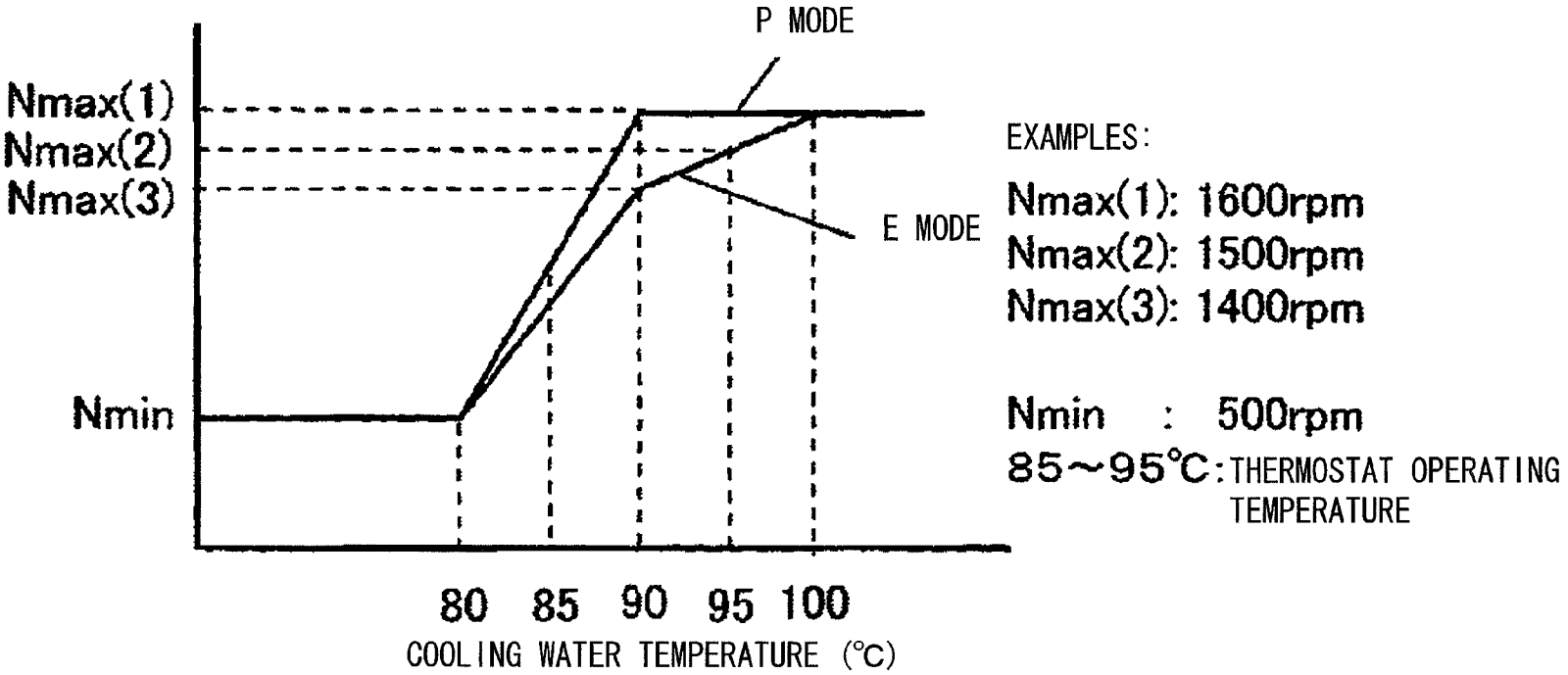
FIG. 7 is a figure showing a relationship between the temperature of the cooling water and a target rotational speed for a fan motor 11.

FIG. 7 is a figure showing the relationship between the temperature of the cooling water and the target rotational speed for the fan motor 11. When the P mode is set, the target rotational speed for the fan motor 11 is set according to the temperature of the cooling water, in the following manner. It should be understood that the relationship between the temperature of the cooling water and the target rotational speed for the fan motor 11 when the P mode is set is the same as when the target rotational speed for the fan motor 11 is not changed according to the output mode of the engine 1, in other words, is the same as the relationship between the temperature of the cooling water and the target rotational speed in the prior art.

(a1) Until the temperature of the cooling water reaches 80° C., the target rotational speed for the fan motor 11 is set to a lowest rotational speed Nmin. Nmin may, for example, be 500 rpm.

(b1) For cooling water temperature from 80° C. to 90, the target rotational speed for the fan motor 11 is set so as gradually to increase from the lowest rotational speed Nmin along with increase of the cooling water temperature, and to reach a highest rotational speed Nmax(1). Nmax(1) may, for example, be 1600 rpm.

(c1) When the temperature of the cooling water exceeds 90° C., the target rotational speed for the fan motor 11 is set to the highest rotational speed Nmax(1).

Moreover, when the E mode is set, the target rotational speed for the fan motor 11 is set according to the temperature of the cooling water, in the following manner.

(a2) Until the temperature of the cooling water reaches 80° C., the target rotational speed for the fan motor 11 is set to the lowest rotational speed Nmin. Nmin may, for example, be 500 rpm.

(b2) For cooling water temperature from 80° C. to 90° C., the target rotational speed for the fan motor 11 is set so as gradually to increase from the lowest rotational speed Nmin along with increase of the cooling water temperature, and to reach a highest rotational speed Nmax(3) may, for example, be 1400 rpm.

(c2) For cooling water temperature from 90° C. to 95° C., the target rotational speed for the fan motor 11 is set so as gradually to increase from the highest rotational speed Nmax (3) along with increase of the cooling water temperature, and to reach a highest rotational speed Nmax(2). Nmax(2) may, for example, be 1500 rpm.

(d2) For cooling water temperature from 95° C. to 100° C., the target rotational speed for the fan motor 11 is set so as gradually to increase from the highest rotational speed Nmax (2) along with increase of the cooling water temperature, and to reach the highest rotational speed Nmax(1).

(e2) When the temperature of the cooling water exceeds 100° C., the target rotational speed for the fan motor 11 is set to the highest rotational speed Nmax(1).

It should be understood that the cooling water temperature of 80° C. in (a2) above is a lower temperature than the temperature at which the thermostat starts to open, and 80° C. is only given as an example, since this temperature is determined as appropriate in order for no problem to arise with temperature of components housed in the enclosure 132 at the lowest rotational speed Nmin. Moreover, the cooling water temperature of 100° C. in (e2) above is a higher temperature than the temperature at which the thermostat is fully open, and 100° C. is only given as an example, since this temperature is determined as appropriate as being below the boiling point of the cooling water, and moreover as being less than or equal to the upper limit temperature at which overheating of the vehicle can be permitted at the highest rotational speed Nmax(1).

Accordingly, when the E mode is set, in the range of cooling water temperature from 80° C. to 100° C., the target rotational speed for the fan motor 11 is reduced as compared to when the P mode is set (in other words, during control of the air cooling fan according to the prior art). Due to this fact, the following benefits become available. For example, if as in the prior art the target rotational speed for the fan motor 11 is not changed according to the output mode of the engine 1, then suppose that the amount of heat Qe generated from the engine 1 and the amount of heat Qr dissipated by the radiator 14 have reached an equilibrium state at the point A shown in FIG. 8. And suppose that, in this case, the temperature of the cooling water has reached 93° C. Then the target rotational speed for the fan motor 11 is set to Nmax(1). Moreover, since the temperature of the cooling water (93° C.) is lower than the temperature at which the theiinostat 22 is fully open (95° C.), accordingly the thermostat 22 is not fully open, and the flow path is narrowed down by the thermostat 22.

Figure 8:
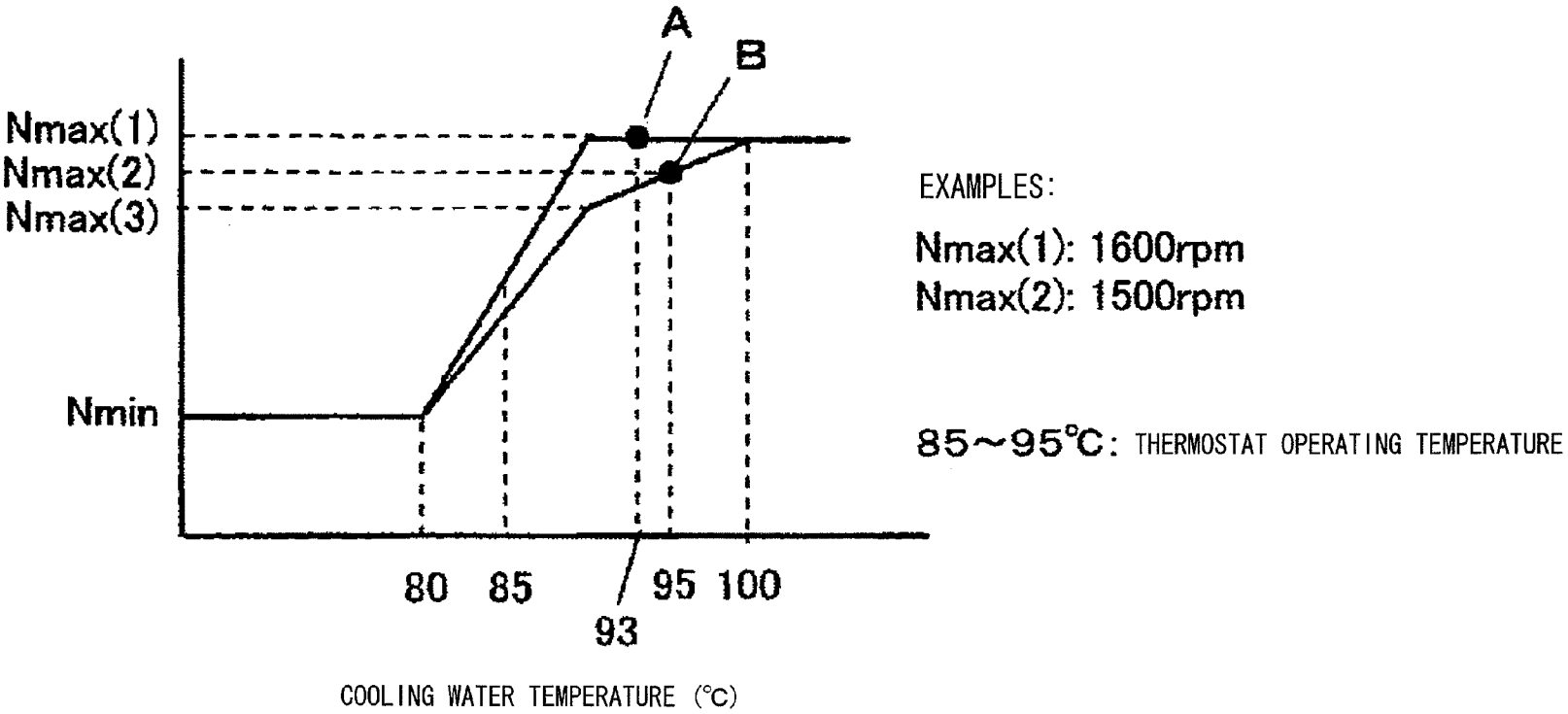
FIG. 8 is a figure for explanation of the beneficial effects of this invention.

Thus, in this embodiment, even with the same quantity Qe of heat being generated from the engine 1 as previously, when the E mode is set, the amount of heat Qe generated from the engine 1 and the amount of heat Qr dissipated by the radiator 14 come into equilibrium at the point B shown in FIG. 8. The reason for this is that, since the target rotational speed for the fan motor 11 is lower as compared to the case in the prior art, accordingly the temperature of the cooling water is slightly elevated as compared with the case in the prior art (at the point A), and for example becomes 95° C. (at the point B), and the heat dissipation characteristic of the radiator 14 is improved due to this rise of temperature (93° C. to 95° C.), so that the amount of heat Qe generated from the engine 1 and the amount of heat Qr dissipated by the radiator 14 reach an equilibrium state at 95° C. The target rotational speed for the fan motor 11 is set to Nmax(2).

In other words, although the temperature of the cooling water is raised due to the fact that the volume of the current of cooling air is reduced, since the aperture area of the thermostat 22 is increased and the rate of flow of cooling water into the radiator 14 is increased, accordingly the heat dissipation performance in the radiator 14 is enhanced, and the amount of heat that is dissipated is increased even though the amount of air flow is reduced. Since the target rotational speed for the fan motor 11 is lowered as compared to the case of the prior art, in other words the relief pressure of the variable relief valve 9 (i.e. the load pressure on the hydraulic pump 8) is reduced, accordingly the power consumption of the hydraulic pump 8 is reduced, and the fuel consumption amount is reduced. Furthermore, the noise of the air cooling fan 13 is also reduced. It should be understood that it is still possible to prevent overheating, since, even when the E mode is set, when the temperature of the cooling water exceeds a temperature (in this embodiment, 100° C.) that is set in advance and is a temperature at which the thermostat 22 becomes fully open, it is arranged to set the target rotational speed for the fan motor 11 to a rotational speed that is the same as the highest rotational speed Nmax(1) when the P mode is set.

—Embodiment Two—

A second embodiment of the work machine according to the present invention will now be explained with reference to FIGS. 9 through 11. In the following explanation the same reference symbols will be appended to structural elements that are the same as corresponding ones of the first embodiment, and the description will focus upon the points of difference. Features that are not explained in particular are the same as in the first embodiment. In this embodiment, the principal aspect of difference from the first embodiment is that the target rotational speed of the fan motor 11 is adjusted so that it becomes the highest from among: a target rotational speed for the fan motor 11 that is set on the basis of the temperature of the cooling water, a target rotational speed for the fan motor 11 that is set on the basis of the temperature of the hydraulic oil, and a target rotational speed for the fan motor 11 that is set on the basis of the temperature of the hydraulic fluid.

Figure 9:
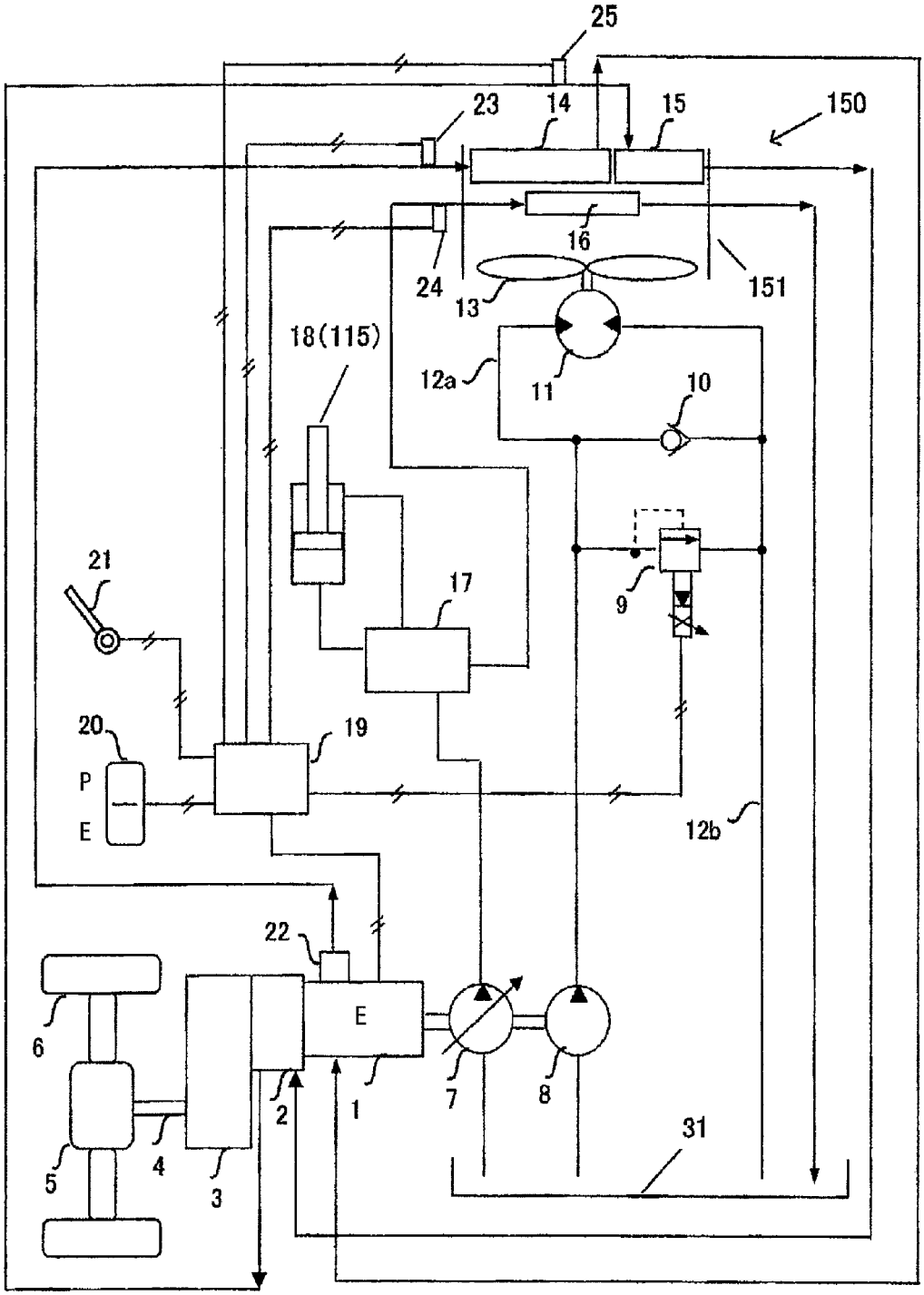
FIG. 9 is a figure showing the general structure of a wheel loader 100 according to a second embodiment.

FIG. 9 is a figure showing the general structure of a wheel loader 100 according to the second embodiment. In order to control the rotation of the fan motor 11, this wheel loader 1 of the second embodiment additionally includes a hydraulic oil temperature sensor 24 and a hydraulic fluid temperature sensor 25. The hydraulic oil temperature sensor 24 and the hydraulic fluid temperature sensor 25 are sensors that detect the temperatures before cooling of, respectively, the hydraulic oil and the hydraulic fluid, and are provided in conduits or the like at the upstream side of, respectively, an oil cooler 16 and a hydraulic fluid cooler 15.

Figure 10:
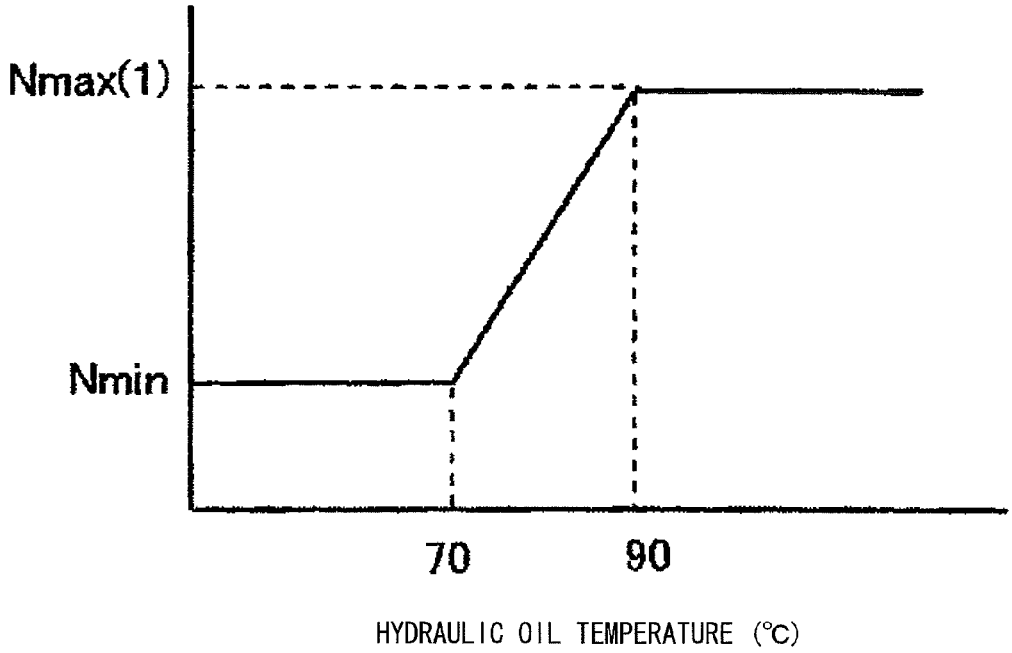
FIG. 10 is a figure showing a relationship between hydraulic oil temperature and target rotational speed for the fan motor 11.

FIG. 10 is a figure showing the relationship between the temperature of the hydraulic oil and the target rotational speed for the fan motor 11. The target rotational speed for the fan motor 11 is set as follows, according to the temperature of the hydraulic oil.

(a3) Until the temperature of the hydraulic oil reaches 70° C., the target rotational speed for the fan motor 11 is set to the lowest rotational speed Nmin.

(b3) For hydraulic oil temperature from 70° C. to 90° C., the target rotational speed for the fan motor 11 is set so as gradually to increase from the lowest rotational speed Nmin along with increase of the hydraulic oil temperature, and so as to reach a highest rotational speed Nmax(1).

(c3) When the temperature of the hydraulic oil exceeds 90° C., the target rotational speed for the fan motor 11 is set to the highest rotational speed Nmax(1).

Figure 11:
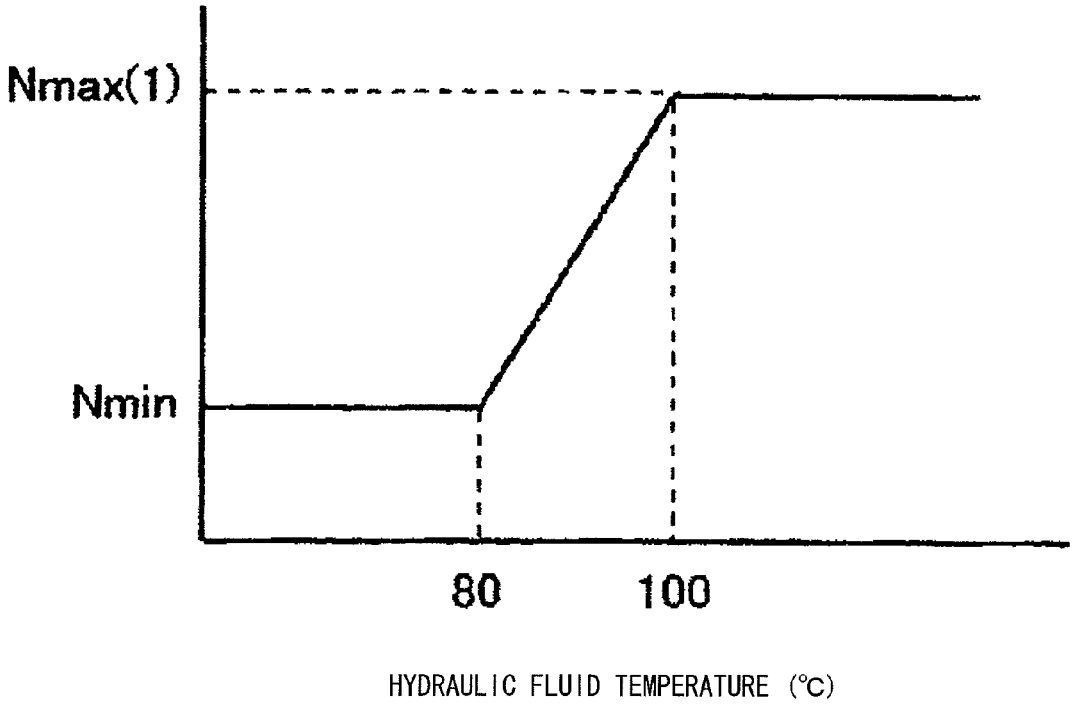
FIG. 11 is a figure showing a relationship between hydraulic fluid temperature and target rotational speed for the fan motor 11.

FIG. 11 is a figure showing the relationship between the temperature of the hydraulic fluid and the target rotational speed for the fan motor 11. The target rotational speed for the fan motor 11 is set as follows, according to the temperature of the hydraulic fluid.

(a4) Until the temperature of the hydraulic fluid reaches 80° C., the target rotational speed for the fan motor 11 is set to the lowest rotational speed Nmin.

(b4) For hydraulic fluid temperature from 80° C. to 100° C., the target rotational speed for the fan motor 11 is set so as gradually to increase from the lowest rotational speed Nmin along with increase of the hydraulic fluid temperature, and so as to reach the highest rotational speed Nmax(1).

(c4) When the temperature of the hydraulic fluid exceeds 100° C., the target rotational speed for the fan motor 11 is set to the highest rotational speed Nmax(1).

And, by controlling the relief pressure of the variable relief valve 9, the controller 19 adjusts the target rotational speed of the fan motor 11 so that it becomes the highest among: the target rotational speed for the fan motor 11 that is set on the basis of the temperature of the cooling water, the target rotational speed for the fan motor 11 that is set on the basis of the temperature of the hydraulic oil, and the target rotational speed for the fan motor 11 that is set on the basis of the temperature of the hydraulic fluid.

By providing this structure, in a similar manner to the case with the first embodiment, apart from it being possible to anticipate reduction of the fuel consumption amount and reduction of the fan noise, it is also possible to cool the cooling water, the hydraulic oil, and the hydraulic fluid in an appropriate manner according to the temperature of the cooling water, the temperature of the hydraulic oil, and the temperature of the hydraulic fluid.

—Variant Embodiments—

(1) The numerical values cited in the above explanation are given as examples; thus, the present invention is not to be considered as being limited by the numerical values in the above description.

(2) While, in the above explanation, it was arranged for the air cooling fan 13 to be driven by the fan motor 11 that was hydraulically powered, the present invention is not limited to this structure. For example, it would also be acceptable to provide a structure in which the air cooling fan 13 is driven by an electrically powered motor.

Figure 12:
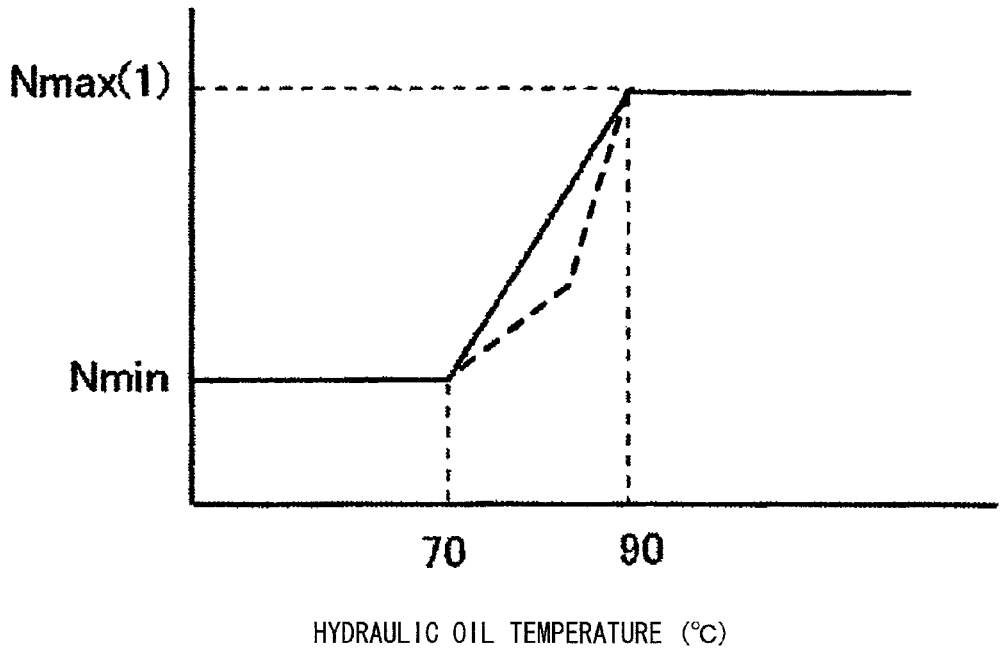
FIG. 12 is a figure showing a variant embodiment.
Figure 13:
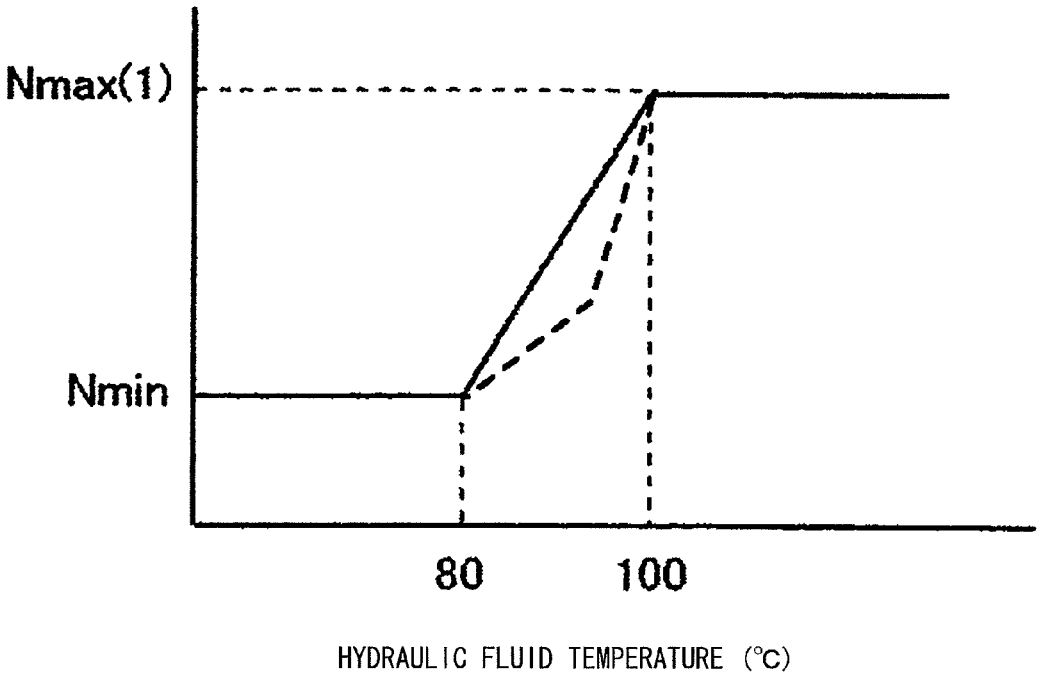
FIG. 13 is a figure showing another variant embodiment.

(3) While, in the above explanation, the relationship between the temperature of the hydraulic oil and the target rotational speed of the fan motor 11, and the relationship between the temperature of the hydraulic fluid and the target rotational speed of the fan motor 11, were determined without any relationship with the output mode of the engine, the present invention is not limited by this feature. For example, as shown by the broken lines in FIGS. 12 and 13, it would also be acceptable to arrange to reduce the rotational speed of the air cooling fan 13 when the E mode is set as compared to when the P mode is set, in a similar manner to the relationship between the temperature of the cooling water and the target rotational speed of the fan motor 11.

(4) While, in the above explanation, embodiments have been explained in which the present invention was applied to a wheel loader 100 of a type that is driven by a torque converter, the present invention is not limited to this application. For example, it would also be possible to apply the present invention to a wheel loader of the so called HST drive type.

(5) While, in the above explanation, examples have been described in which the present invention is applied to a wheel loader, the present invention could also be applied in a similar manner to an industrial vehicle of some other type, such as a wheel shovel or a fork lift or the like.

(6) It would also be acceptable to combine the embodiments and the variant embodiments described above in any of various combinations.

It should be understood that the present invention is not to be considered as being limited in any way by the embodiments described above; it also includes work machines of various types of construction, characterized by including: an engine; a radiator for cooling the cooling water of the engine; a thermostat, provided upon a path that conducts the cooling water to the radiator, and that opens and closes the path between fully closed and fully open according to the temperature of the cooling water; a fan device that blows external air at the radiator; an output changeover switch that changes over the output of the engine between high and low; a rotational speed setting means that sets a rotational speed for the fan device according to the temperature of the cooling unit; and a rotational speed adjustment means that adjusts the rotational speed of the fan device so that it becomes equal to the speed set by the rotational speed setting means; and wherein, within the temperature range for the cooling water in which the thermostat is fully opened from fully closed, the rotational speed setting means sets the rotational speed of the fan device to be lower when the output changeover switch is changed over so that the output of the engine becomes low, as compared to when the output changeover switch is changed over so that the output of the engine becomes high.

While various embodiments and variant embodiments have been explained in the above description, the present invention is not to be considered as being limited by the details thereof. Other embodiments that are considered to fall within the range of the technical concept of the present invention are also to be included within the scope of the present invention.

The content of the disclosure of the following application, upon which priority is claimed, is hereby incorporated herein by reference:

Japanese Patent Application 139,087 of 2010 (filed on 18 Jun. 2010).

The invention claimed is:

1. A work machine, comprising:

an engine;

a radiator for cooling a cooling water of the engine;

a thermostat, provided upon a path that conducts the cooling water to the radiator, and that increases its aperture area as a temperature of the cooling water increases within a cooling water temperature range from an opening-start temperature at which the thermostat starts opening to a fully-open temperature at which the thermostat is fully open, to increase a flow rate of the cooling water supplied to the radiator;

a fan device that blows external air at the radiator;

an output changeover switch that is operated to select one of a first mode in which an output of the engine is limited and a second mode in which the output of the engine is not limited;

a rotational speed setting unit that sets a target rotational speed for the fan device according to the temperature of the cooling water; and a rotational speed adjustment unit that adjusts a rotational speed of the fan device to be equal to the target rotational speed set by the rotational speed setting unit, wherein:

the rotational speed setting unit sets the target rotational speed of the fan device to be lower in the first mode selected by the output changeover switch and to be higher in the second mode selected by the output changeover switch at any temperature within the cooling water temperature range between the opening-start temperature and the fully-open temperature.

2. A work machine according to claim 1, further comprising:

a hydraulic oil cooler for cooling hydraulic oil supplied by a hydraulic pump; and a hydraulic oil temperature dependent rotational speed setting unit that sets a target rotational speed of the fan device according to a temperature of the hydraulic oil, wherein:

the fan device blows external air at the radiator and the hydraulic oil cooler; and the rotational speed adjustment unit adjusts the rotational speed of the fan device to be a higher rotational speed among the target rotational speed set by the rotational speed setting unit, and the target rotational speed set by the hydraulic oil temperature dependent rotational speed setting unit.

3. A work machine according to claim 1, further comprising:

a hydraulic fluid cooler for cooling hydraulic fluid of a torque converter that transmits propulsion drive force; and a hydraulic fluid temperature dependent rotational speed setting unit that sets a target rotational speed of the fan device according to a temperature of the hydraulic fluid, wherein:

the fan device blows external air at the radiator and the hydraulic fluid cooler; and the rotational speed adjustment unit adjusts the rotational speed of the fan device to be a higher rotational speed among the target rotational speed set by the rotational speed setting unit and the target rotational speed set by the hydraulic fluid temperature dependent rotational speed setting unit.

4. A work machine according to claim 1, further comprising:

a hydraulic oil cooler for cooling hydraulic oil supplied by a hydraulic pump;

a hydraulic oil temperature dependent rotational speed setting unit that sets a target rotational speed of the fan device according to a temperature of the hydraulic oil;

a hydraulic fluid cooler for cooling hydraulic fluid of a torque converter that transmits propulsion drive force; and a hydraulic fluid temperature dependent rotational speed setting unit that sets a target rotational speed of the fan device according to a temperature of the hydraulic fluid, wherein:

the fan device blows external air at the radiator, the hydraulic oil cooler, and the hydraulic fluid cooler; and the rotational speed adjustment unit adjusts the rotational speed of the fan device to be a highest rotational speed among the target rotational speed set by the rotational speed setting unit, the target rotational speed set by the hydraulic oil temperature dependent rotational speed setting unit, and the target rotational speed set by the hydraulic fluid temperature dependent rotational speed setting unit.

5. A work machine, comprising:

an engine;

a radiator for cooling a cooling water of the engine;

a thermostat, provided upon a path that conducts the cooling water to the radiator, and that increases its aperture area as a temperature of the cooling water increases within a cooling water temperature range from an opening-start temperature at which the thermostat starts opening to a fully-open temperature at which the thermostat is fully open, to increase a flow rate of the cooling water supplied to the radiator;

a fan device that blows external air at the radiator;

an output changeover switch that is operated to select one of a first mode in which an output of the engine is limited and a second mode in which the output of the engine is not limited;

a rotational speed setting unit that sets a target rotational speed for the fan device according to the temperature of the cooling water; and a rotational speed adjustment unit that adjusts a rotational speed of the fan device to be equal to the target rotational speed set by the rotational speed setting unit, wherein:

the rotational speed setting unit sets the target rotational speed of the fan device to be lower in the first mode selected by the output changeover switch and to be higher in the second mode selected by the output changeover switch at any temperature within the cooling water temperature range between the opening-start temperature and the fully-open temperature; and the rotational speed setting unit also sets the target rotational speed of the fan device to be lower in the first mode selected by the output changeover switch and to be higher in the second mode selected by the output changeover switch at any temperature within a range between a first predetermined temperature lower than the opening start temperature and a second predetermined temperature higher than the fully-open temperature.

6. A work machine according to claim 5, further comprising:

a hydraulic oil cooler for cooling hydraulic oil supplied by a hydraulic pump; and a hydraulic oil temperature dependent rotational speed setting unit that sets a target rotational speed of the fan device according to a temperature of the hydraulic oil, wherein:

the fan device blows external air at the radiator and the hydraulic oil cooler; and the rotational speed adjustment unit adjusts the rotational speed of the fan device to be a higher rotational speed among the target rotational speed set by the rotational speed setting unit, and the target rotational speed set by the hydraulic oil temperature dependent rotational speed setting unit.

7. A work machine according to claim 5, further comprising:

a hydraulic fluid cooler for cooling hydraulic fluid of a torque converter that transmits propulsion drive force; and a hydraulic fluid temperature dependent rotational speed setting unit that sets a target rotational speed of the fan device according to a temperature of the hydraulic fluid, wherein:

the fan device blows external air at the radiator and the hydraulic fluid cooler; and the rotational speed adjustment unit adjusts the rotational speed of the fan device to be a higher rotational speed among the target rotational speed set by the rotational speed setting unit and the target rotational speed set by the hydraulic fluid temperature dependent rotational speed setting unit.

8. A work machine according to claim 5, further comprising:

a hydraulic oil cooler for cooling hydraulic oil supplied by a hydraulic pump;

a hydraulic oil temperature dependent rotational speed setting unit that sets a target rotational speed of the fan device according to a temperature of the hydraulic oil;

a hydraulic fluid cooler for cooling hydraulic fluid of a torque converter that transmits propulsion drive force; and a hydraulic fluid temperature dependent rotational speed setting unit that sets a target rotational speed of the fan device according to a temperature of the hydraulic fluid, wherein:

the fan device blows external air at the radiator, the hydraulic oil cooler, and the hydraulic fluid cooler; and the rotational speed adjustment unit adjusts the rotational speed of the fan device to be a highest rotational speed among the target rotational speed set by the rotational speed setting unit, the target rotational speed set by the hydraulic oil temperature dependent rotational speed setting unit, and the target rotational speed set by the hydraulic fluid temperature dependent rotational speed setting unit.

9. A work machine according to claim 5, wherein, if the temperature of the cooling water is greater than or equal to a third predetermined temperature higher than the second predetermined temperature in the first mode selected by the output changeover switch, the rotational speed setting unit sets the target rotational speed of the fan device to a same rotational speed as when the second mode is selected by the output changeover switch.

* * * * *